US009541358B2

(12) United States Patent
Hepburn

(10) Patent No.: US 9,541,358 B2
(45) Date of Patent: Jan. 10, 2017

(54) BLOW PIPE DART

(71) Applicant: Ralph Robertson Hepburn, Edinburgh (GB)

(72) Inventor: Ralph Robertson Hepburn, Edinburgh (GB)

( * ) Notice: Subject to any disclaimer, the term of this patent is extended or adjusted under 35 U.S.C. 154(b) by 10 days.

(21) Appl. No.: 14/185,999

(22) Filed: Feb. 21, 2014

(65) Prior Publication Data

US 2014/0261361 A1 Sep. 18, 2014

(30) Foreign Application Priority Data

Mar. 15, 2013 (GB) ..... 1304693.3

(51) Int. Cl.
*F41F 1/00* (2006.01)
*F42B 6/00* (2006.01)
*F41B 1/00* (2006.01)

(52) U.S. Cl.
CPC *F42B 6/003* (2013.01); *F41B 1/00* (2013.01)

(58) Field of Classification Search
USPC ..... 124/62; 138/118; 446/231; 166/334.4
See application file for complete search history.

(56) References Cited

U.S. PATENT DOCUMENTS 3,021,640 A * 2/1962 Moore ..... A63H 27/14 446/231
4,537,176 A * 8/1985 Stravitz ..... F42B 6/00 124/41.1
5,718,214 A * 2/1998 Altman ..... F41B 1/00 124/62
2005/0230119 A1* 10/2005 McGarian et al. ..... 166/334.4
2011/0108150 A1* 5/2011 Renaud ..... F16L 3/06 138/118
2011/0187053 A1* 8/2011 Mayorkis ..... A63F 9/02 273/408
2013/0213377 A1* 8/2013 Kenworthy ..... F42B 6/003 124/62

* cited by examiner

*Primary Examiner* — Gene Kim
*Assistant Examiner* — Christopher Glenn
(74) *Attorney, Agent, or Firm* — Dennis R. Haszko

(57) ABSTRACT

An elastomeric blow pipe dart (10) including: a generally circular body portion (12); a tapered portion (16) extending from the generally circular body portion (12); and a nose (18) having a smaller diameter than the tapered portion (16) and extending from the tapered portion (16) to a tip (20). The blow pipe dart (10) may comprise a soft rubber, and the nose (18) may define an end bore (26) so that air passes through the nose (18) when the dart (10) is launched.

10 Claims, 2 Drawing Sheets

BLOW PIPE DART

FIELD OF THE INVENTION

The present invention relates to a blow pipe dart. In particular, although not exclusively, for use as a children's toy for target practice, games, and the like.

BACKGROUND OF THE INVENTION

Blow pipes are well known, but use of a blow pipe as a children's toy is hampered by the risk of injuring a person hit by a dart from such a blow pipe.

It would be advantageous to obviate or mitigate this disadvantage.

SUMMARY OF THE INVENTION

According to a first aspect of the invention there is provided an elastomeric blow pipe dart comprising: a generally circular body portion, a tapered portion extending from the generally circular body portion, and a nose having a smaller diameter than the tapered portion and extending from the first tapered portion to a tip.

The nose may taper from the tapered portion to the tip.

The nose may define a bore extending from the tip to the tapered portion. This would allow air expelled by a user into a blow pipe to pass through the nose of the dart, thereby reducing the speed of the dart to make it safer for use. Passage of air through the nose may also help the aerodynamic properties of the dart. Furthermore, by having an aperture at the tip (that is, by having a bore through the nose), the nose will deform easily on impact, thereby reducing any pain experienced by someone who is hit by the dart.

The body may be molded from soft rubber. This may also reduce any pain experienced by someone who is hit by the dart, and may lower the risk of injury to such a person.

The dart may further comprise a circular boss protruding from the circular body portion. This provides reduced contact between the dart and an inner wall of a blow pipe.

According to a second aspect of the present invention there is provided a blow pipe defining a bore dimensioned to be slightly wider than a diameter of a blow pipe dart according to the first aspect of the invention.

The blow pipe may further comprise a removable dart holder.

The dart holder may comprise an arcuate body dimensioned to fit around the blow pipe and including a plurality of projections extending radially therefrom, each projection being dimensioned to receive one or more darts.

The darts may be held onto the projection by an interference fit between the bore defined by the nose and an external surface of the projection.

The arcuate body may be annular so that the dart holder is slidably located onto and slidably removed from the blow pipe. Alternatively, the arcuate body may be C-shaped so that it can be clipped onto the blow pipe.

A plurality of dart holders may be mounted on the blow pipe, each dart holder defining a docking area recess so that adjacent dart holders can co-operate to receive and hold a linear clearance rod mounted there between. The clearance rod can be unclipped from the docking area recesses when required to remove a dart stuck in the blow pipe.

According to a third aspect of the present invention there is provided a removable dart holder comprising an arcuate body dimensioned to fit around a blow pipe and including a plurality of projections extending radially therefrom, each projection being dimensioned to receive one or more darts.

The darts may be held onto the projection by an interference fit between the bore defined by the nose and an external surface of the projection.

According to a fourth aspect of the invention there is provided an elastomeric blow pipe dart comprising: a generally circular body portion, and a nose having a smaller diameter than the body portion and extending from the body portion to a tip.

According to a fifth aspect of the invention there is provided an elastomeric blow pipe dart substantially as described with reference to FIGS. 1 to 3 of the accompanying drawings.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
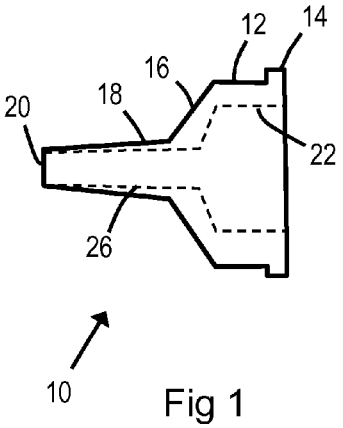
FIG. 1 is a side view of a blow pipe dart according to one embodiment of the present invention.
Figure 2:
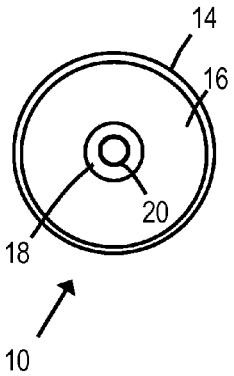
FIG. 2 is a front elevation of the dart of FIG. 1.
Figure 3:
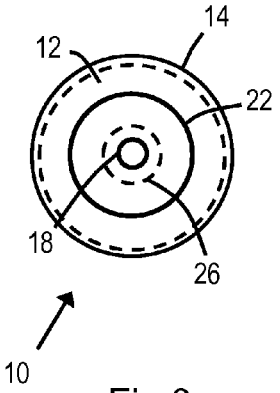
FIG. 3 is a rear elevation of the dart of FIG. 1.

Reference will first be made to FIGS. 1 to 3, which illustrate a blow pipe dart 10 according to one embodiment of the present invention.

The dart 10 is injection molded from a single piece of elastomeric material (in this embodiment soft rubber) and comprises a generally circular body portion 12. In this embodiment, the body portion is approximately 19 mm in diameter. Extending outwardly from this circular body portion 12 by a small amount (approximately 0.5 mm in this embodiment) is a boss or rim 14. The boss 14 creates a small contact area for the dart 10 when located within a blow pipe (not shown in FIGS. 1 to 3).

A first tapered portion 16 extends from the body portion 12 to a nose 18. The first tapered portion 16 is approximately 4 mm long, and tapers from a diameter of approximately 19 mm to a diameter of approximately 7 mm.

In this embodiment, the nose 18 is also slightly tapered, from approximately 7 mm at the first tapered portion end to approximately 5 mm at a tip 20 of the nose 18.

The generally circular body portion 12 defines a main bore 22 (approximately 12 mm in diameter) and the nose 18 defines an end bore 26 (approximately 4 mm in diameter). Thus, when the dart 10 is located within a blow pipe, and a user (such as a child) blows into the blow pipe, some of the air expelled by the user passes through the main bore 22 and then the end bore 26. This may help in guiding the dart 10, and also reduces the force of air that is applied to the dart 10 when the dart 10 is launched.

Figure 4:
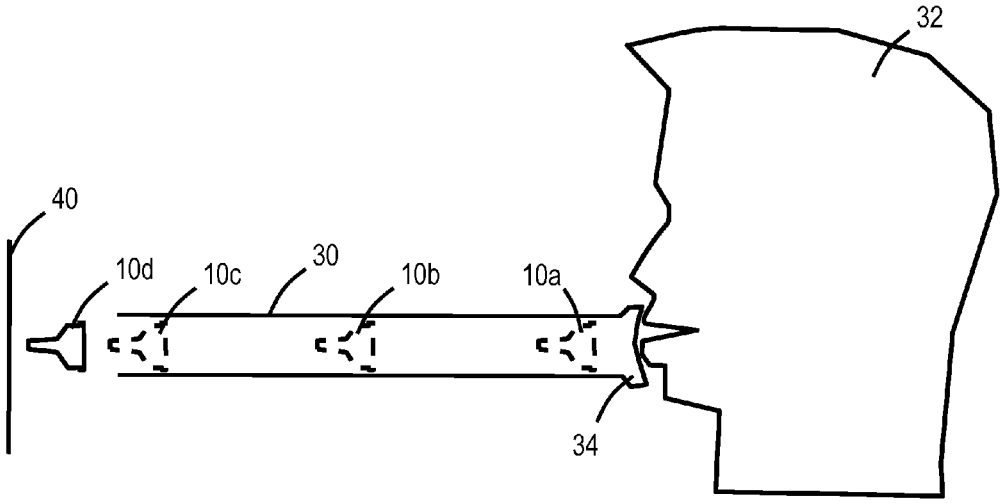
FIG. 4 is a schematic diagram illustrating a user blowing into a blow pipe to launch the dart illustrated in FIGS. 1 to 3.

Reference will now also be made to FIG. 4 which shows the dart 10 at various positions (shown as 10*a*, 10*b*, 10*c*) within a blow pipe 30 during launch of the dart 10.

The blow pipe 30 defines an internal bore of approximately 20.1 mm.

Initially, the user 32 inserts the dart 10 into the blow pipe 30 at a mouth piece 34. The boss 14 of the dart 10 is a close fit within the internal bore of the blow pipe 30 (the gap between the boss 14 and the blow pipe inner bore is very small, of the order of approximately 0.05 mm). When the user 32 blows out rapidly into the mouthpiece 34, air from the user's mouth pushes the dart 10 forward. Some of the user's expelled air passes through the main bore 22 and the end bore 26, thereby reducing the speed of the dart 10 and helping the dart 10 to fly linearly.

The dart 10 passes through the blow pipe 30 (shown by darts 10*b* and 10*c*) and then exits the blow pipe 30 towards a target 40 (shown as dart 10*d*).

On striking the target 40, the nose 18 deforms, thereby reducing the energy of the impact, and then returns to its original shape so that the dart 10 can be re-used in the blow pipe 30.

Figure 5:
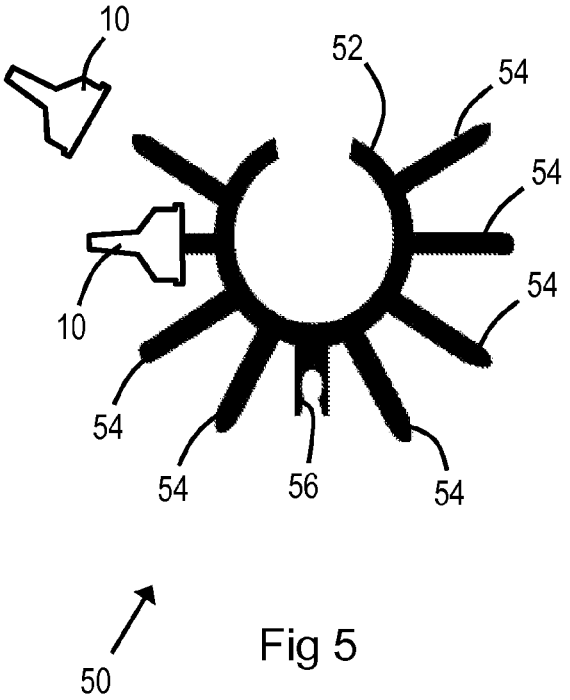
FIG. 5 is a schematic diagram illustrating a dart holder operable to clip onto the blow pipe of FIG. 4.

Reference is now also made to FIG. 5, which is a schematic diagram illustrating a removable dart holder 50 operable to clip onto the blow pipe 30. The dart holder 50 comprises an arcuate body 52 (in the form of a C-shape) dimensioned to fit around the blow pipe 30 and including a plurality of projections 54 extending radially from the arcuate body 52. Each projection 54 defines a shallow cone (or frusto-conical) shape with an external diameter tapering from approximately 6 mm to approximately 4 mm. This enables several darts 10 to be pushed onto each projection 54 and to be retained securely on the projection 54 by an interference fit.

The arcuate body 52 further defines a docking area recess 56.

Figure 6:
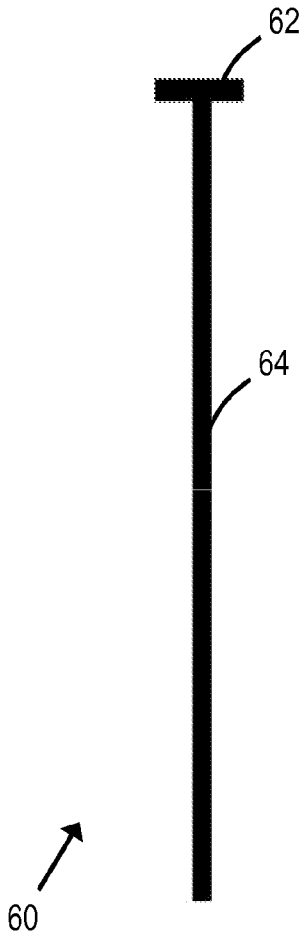
FIG. 6 is a schematic diagram of a linear clearance rod for unblocking the darts of FIGS. 1 to 3 from the blow pipe of FIG. 4.

Reference will now also be made to FIG. 6, which is a schematic diagram of a linear clearance rod 60 for unblocking darts 10 that are stuck within the blow pipe 30. The clearance rod 60 comprises a handle 62 and an elongated finger 64 extending from the handle 62. If a dart 10 is stuck within the blow pipe 30, then the user 32 can insert the elongated finger 64 into the mouth piece 34 and push the elongated finger 64 through the blow pipe 30. The elongated finger 64 will engage with the end bore 26 of the stuck dart 10, allowing the dart 10 to be pushed out of the blow pipe 30 by the clearance rod 60.

If two or more removable dart holders 50 are mounted on the blow pipe 30, then the clearance rod 60 can be clipped between the dart holders 50 by pressing the elongated finger 64 into the docking area recesses 56. The clearance rod 60 can be unclipped from the docking area recesses 56 when required to remove a dart 10 stuck in the blow pipe 30.

Various modifications may be made to the above described embodiment within the scope of the present invention. For example, the dart may be made from a different elastomeric material than the one described above.

In other embodiments, there may be no tapered portion between the body and the nose. For example, the nose may taper from the body portion to the tip.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A blow dart apparatus for amusement, the apparatus comprising:

a blow pipe (30) formed by a hollow tube; and an elastomeric blow pipe dart (10) for insertion within the blow pipe (30), the hollow tube dimensioned to be slightly wider than a diameter of the blow pipe dart (10), the blow pipe dart (10) molded from soft rubber and having:

a generally circular body portion (12);

a tapered portion (16) extending from the generally circular body portion (12), the tapered portion (16) being centrally located within the dart (10);

a circular boss (14) protruding from the circular body portion (12), the circular boss (14) spacing the circular body portion (12) and the tapered portion (16) apart and away from an inner wall of the blow pipe thereby providing reduced contact between the dart (10) and the inner wall of the blow pipe (30), the circular boss (14) being located at a rear-most extreme location of the dart (10);

a main bore (22) located within the body portion (12);

a nose (18) having a smaller diameter than the tapered portion (16) and extending from the tapered portion (16) to a tip (20) located at a front-most extreme location of the dart (10), the nose (18) being narrow and tapered from the tapered portion (16) to the tip (20), the body portion (12) being located within the dart (10) between the tapered portion (16) and the circular boss (14);

an end bore (26) located within the nose (18), the end bore (26) having a smaller diameter than the main bore (22) thereby forming a restriction of air flow at the tapered portion (16) so as to provide limited leakage of air from the tip (20); and a contiguous passage formed internal to the dart (10) and extending along a longitudinal axis of the dart (10) from the front-most location of the dart (10) to the rear-most location of the dart (10) for air flow formed by the end bore (26) and the main bore (22) where the limited leakage of air from the tip (20) provides pressure reduction within the main bore (22) thus reducing speed of the dart.

2. The apparatus according to claim 1, the blow pipe further including a removable dart holder (50).

3. The apparatus according to claim 2, wherein the removable dart holder (50) includes an arcuate body (52) dimensioned to fit around the blow pipe (30) and including a plurality of projections (54) extending radially therefrom, each projection (54) being dimensioned to receive one or more darts (10).

4. The apparatus according to claim 3, wherein the arcuate body (52) is annular so that the dart holder (50) may be slidably located onto and slidably removed from the blow pipe (30).

5. The apparatus according to claim 3, wherein the arcuate body (52) is C-shaped so that it can be removably clipped onto the blow pipe (30).

6. The apparatus according to claim 5, wherein the dart holder (50) defines a docking area recess (56).

7. The apparatus according to claim 6, wherein a plurality of dart holders (50) are mounted on the blow pipe (30), each dart holder (50) defining a docking area recess (56) so that adjacent dart holders (50) can co-operate to receive and hold a linear clearance rod (60) mounted there between.

8. The apparatus according to claim 7, wherein the clearance rod can be unclipped from the docking area recesses (56) when required to remove a dart (10) stuck in the blow pipe (30).

9. A blow dart apparatus for amusement, the apparatus comprising:

a blow pipe (30) formed by a hollow tube; and an elastomeric blow pipe dart (10) for insertion within the blow pipe (30), the hollow tube dimensioned to be slightly wider than a diameter of the blow pipe dart (10), the blow pipe dart (10) molded from soft rubber and having:

a generally circular body portion (12);

a tapered portion (16) extending from the generally circular body portion (12), the tapered portion (16) being centrally located within the dart (10);

a circular boss (14) protruding from the circular body portion (12), the circular boss (14) spacing the circular body portion (12) and the tapered portion (16) apart and away from an inner wall of the blow pipe thereby providing reduced contact between the dart (10) and the inner wall of the blow pipe (30), the circular boss (14) being located at a rear-most extreme location of the dart (10);

a main bore (22) located within the body portion (12) wherein side walls thereof have a first thickness;

a nose (18) having a smaller diameter than the tapered portion (16) and extending from the tapered portion (16) to a tip (20) located at a front-most extreme location of the dart (10) wherein the nose (18) is narrow and tapers from the tapered portion (16) to the tip (20), the body portion (12) being located within the dart (10) between the tapered portion (16) and the circular boss (14);

an end bore (26) contiguous with the main bore (22) and located within the nose (18), the end bore (26) having a smaller diameter than the main bore (22) wherein side walls thereof have a second thickness significantly less than the first thickness; and the side walls of the end bore (26) are sufficiently thin relative to the side walls of the main bore (22) thereby providing a means for easily deforming the nose (18) upon impact.

10. The apparatus according to claim 9, the blow pipe further including a removable dart holder (50).

* * * * *